US006314251B1

(12) United States Patent
Gomi et al.

(10) Patent No.: US 6,314,251 B1
(45) Date of Patent: Nov. 6, 2001

(54) IMAGE FORMING APPARATUS

(75) Inventors: Fumiteru Gomi, Shizuoka-ken; Satoru Fukushima, Yokohama; Yoichi Kimura, Numazu; Makoto Ohki, Mishima; Shigeru Matsuzaki; Kouichi Hashimoto, both of Numazu; Yoshiyuki Komiya, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/488,776

(22) Filed: Jan. 21, 2000

(30) Foreign Application Priority Data

Jan. 26, 1999 (JP) ..... 11-017220

(51) Int. Cl.[7] ..... G03G 15/00
(52) U.S. Cl. ..... 399/38; 46/50
(58) Field of Search ..... 399/38, 50, 53, 399/99, 100, 101, 115, 148, 168, 174, 175, 176, 179, 299, 306; 430/45, 111

(56) References Cited

U.S. PATENT DOCUMENTS

| | | | | |
|---|---|---|---|---|
| 5,386,286 | | 1/1995 | Kinouchi et al. . | |
| 5,693,441 | | 12/1997 | Gibson et al. | 430/45 |
| 5,819,138 | | 10/1998 | Hashizume | 399/98 |
| 5,890,038 | | 3/1999 | Ohsawa et al. | 399/228 |
| 5,895,146 | * | 4/1999 | Waki et al. | 399/170 |
| 6,006,055 | * | 12/1999 | Furuya | 399/149 |
| 6,029,033 | * | 2/2000 | Kawasaki | 399/149 |
| 6,077,635 | * | 6/2000 | Okado et al. | 430/45 |

FOREIGN PATENT DOCUMENTS 0 886 187 A2 12/1998 (EP) .

* cited by examiner

*Primary Examiner*—Sandra Brase
*Assistant Examiner*—Hoang Ngo
(74) *Attorney, Agent, or Firm*—Fitzpatrick, Cella, Harper & Scinto

(57) ABSTRACT

An image forming apparatus in which each of first and second image forming device is in contact with surfaces of first and second image bearing members from which no after-transfer residual toner is removed includes a rotating charging member contacting first and second image bearing members, and a developing unit for developing an electrostatic image on the image bearing member and rotation controlling device rotates the second image bearing member and the charging member of the second image forming device during image formation only with the first image forming device.

12 Claims, 4 Drawing Sheets

IMAGE FORMING APPARATUS

BACKGROUND OF THE INVENTION

1. Field of the Invention

The present invention relates to a copying machine, a printer and other image forming apparatuses which use an electrophotographic system or an electrostatic recording system, particularly to an image forming apparatus which is provided with a plurality of image forming sections and which can form an image in a plurality of colors.

2. Related Background Art

In recent years, as an electrophotographic apparatus, a color image forming apparatus of a tandem system has been developed which has image bearing members (photosensitive members) and developing units for four colors and which forms a color image by overlapping four-color images on a sheet with one path. The apparatus has a merit suitable for performing color recording at a high speed.

Even in this system, image formation can also be performed with a single color, and in this case an image forming process of a color with which no image is formed is stopped. However, since the photosensitive member lightly contacts a belt for conveying a sheet or a resin sheet as a transfer material, the photosensitive member is usually rotated not to be damaged.

On the other hand, the miniaturization of the image forming apparatus has been advanced, but even when each of the charging, exposing, developing, transferring, fixing, and cleaning processes is reduced in size, there is a limitation. Moreover, after the transferring process, the transfer residual toner remaining on the surface of the photosensitive member is cleaned by a cleaner and collected (recovered) as waste toner, but it is preferable not to generate this waste toner.

To solve the problem, a cleanerless image forming apparatus has been proposed in which developing and cleaning are performed by a developing unit at the same time. This simultaneous developing and cleaning (cleaning simultaneous with developing) method comprises recovering the transfer residual toner on the photosensitive member by a fog removing bias into the developing unit during developing in the subsequent processes. According to this method, since the transfer residual toner can be used in the subsequent processes, the waste toner can be eliminated, and the trouble of maintenance can be saved. Furthermore, advantages are also large in a spatial respect, and the image forming apparatus can remarkably be miniaturized.

When this cleaner system is employed in the image forming apparatus of the tandem system, a new problem has arisen.

Specifically, during the monochromatic mode in the tandem system, or when originals with images of single color and a plurality of colors are mixed and loaded, the sheet as the transfer material or a second image bearing member contacts each color photosensitive member, and the photosensitive member of the color with which no image is formed has to be simultaneously rotated. Moreover, particularly when the image forming section of the color with which the image is to be formed is not disposed first in order of passage of the transfer material, a transfer bias for adsorbing the transfer material to a conveying belt has to be applied in the image forming section of the color with which no image is formed. In this case, while toner is still unconsumed, the photosensitive member surface is influenced by paper dust or electric discharge by transfer. Therefore, a smeared image is remarkably generated.

When a cleaning blade is disposed, the surface of the photosensitive member is abraded with the toner or an externally added material by the abutment pressure of the blade. In the cleanerless system, however, there is a problem of the smeared image (smudging) during the full-color image formation subsequent to the monochromatic mode.

SUMMARY OF THE INVENTION

An object of the present invention is to provide an image forming apparatus in which a cleanerless system is employed in each of a plurality of image forming sections.

Another object of the present invention is to provide an image forming apparatus in which both a monochromatic mode and a full-color mode can be realized.

A further object of the present invention is to provide an image forming apparatus in which no smeared image is generated.

A still further object of the present invention is to provide an image forming apparatus, which comprises first image forming means provided with a rotating first image bearing member for bearing a toner image; second image forming means provided with a rotating second image bearing member for bearing a toner image; and transferring means for overlapping the toner images of the first image bearing member and the second image bearing member onto a member to be transferred (transfer member), or transferring one of the toner images to the transfer member. Each of the first and second image forming means contacts the surfaces of the first and second image bearing members from which no transfer residual toner is removed, and comprises a rotating charging member for contacting the image bearing members, and a developing unit for developing an electrostatic image on the image bearing member. The image forming apparatus further comprises rotation controlling means for controlling the rotation of the charging member and the image bearing member. The rotation controlling means rotates the second image bearing member and the charging member of the second image forming means during image formation only with the first image forming means.

Further objects of the present invention will be apparent in the following description.

DESCRIPTION OF THE PREFERRED EMBODIMENTS

Embodiments of the present invention will be described hereinafter in detail with reference to the drawings.

First Embodiment

Figure 1:
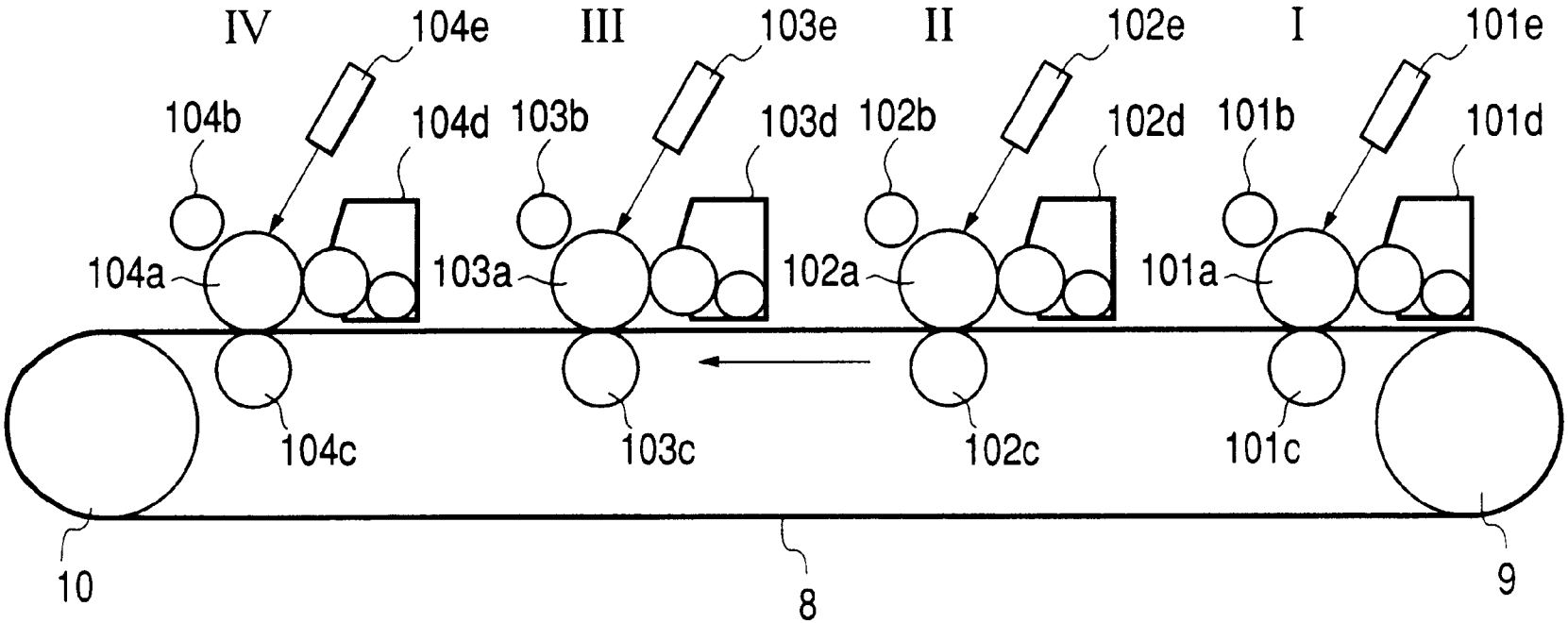
FIG. 1 is a sectional view showing one embodiment of an image forming apparatus of the present invention.

FIG. 1 is a schematic view showing one embodiment of an image forming apparatus of the present invention. The present image forming apparatus is a color image forming apparatus of an electrophotographic system in which image bearing members as photosensitive members having photoconductive layers are arranged in tandem.

In the color image forming apparatus of FIG. 1, first, second, third, and fourth image forming sections I, II, III, IV which can form visualized images of yellow, cyan, magenta, and black are arranged in tandem in an apparatus main body. The image forming sections I to IV are provided with drum-shaped image bearing members (photosensitive drums) 101*a*, 102*a*, 103*a*, 104*a* having photoconductive layers. In the peripheries of the photosensitive drums 101*a*, 102*a*, 103*a*, 104*a*, there are arranged first chargers 101*b*, 102*b*, 103*b*, 104*b* as dedicated image forming means, transferring units 101*c*, 102*c*, 103*c*, 104*c*, developing units 101*d*, 102*d*, 103*d*, 104*d*, exposing units 101*e*, 102*e*, 103*e*, 104*e*, and the like. In the first embodiment, the image forming apparatus employs a cleanerless system, and is provided with no conventional cleaning apparatus.

To perform color image formation, first, in the first image forming section I, an electric charge is uniformly applied to the surface of the rotating photosensitive drum 101*a* by the charger 101*b*, image exposure is performed by the exposing unit 101*e*, and an electrostatic latent image is formed on the photoconductive layer on the surface of the photosensitive drum 101*a*. Subsequently, the latent image is developed using a yellow developer by the developing unit 101*d*, and visualized as a yellow toner image.

Figure 2:
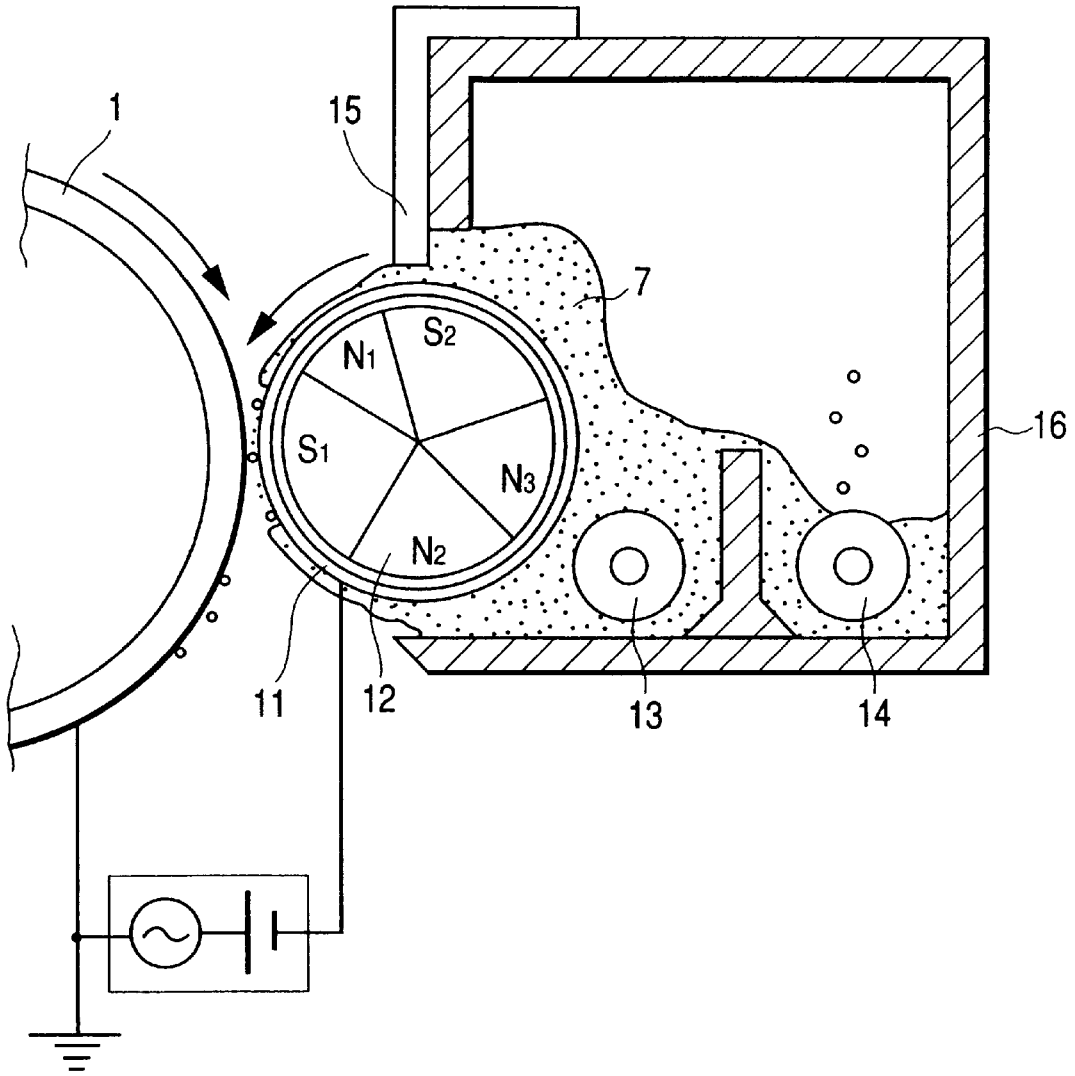
FIG. 2 is a sectional view showing a two-component developing apparatus for use in the present invention.

A developing process will be described. FIG. 2 is a schematic view of a two-component magnetic brush developing apparatus for use in the first embodiment. As shown in FIG. 2, the developing apparatus is constituted by arranging a developing sleeve 11, a magnet roller 12 fixedly disposed in this developing sleeve 11, agitating screws 13, 14, and a regulating blade 15 for forming a thin toner layer on the surface of the developing sleeve 11 in a developing container 16 in which a two-component developer is contained.

The developing sleeve 11 is disposed so that its area closest to the photosensitive drum 1 is about 500 $\mu$m, and set so that developing can be performed with the developer in contact with the photosensitive drum 1. The two-component developer for use in the first embodiment is obtained by externally adding 1% by weight of titanium oxide having an average particle diameter of 20 nm to a negative charge toner manufactured by a grinding method and having an average particle diameter of 6 $\mu$m, and mixing a magnetic carrier with a saturation magnetization of 205 emu/cm$^3$ and an average particle diameter of 35 $\mu$m. The mixture ratio of the toner and the carrier is set to 6:94 in terms of a weight ratio.

The developing process of using the above-described developing apparatus to develop the latent image by a two-component magnetic brush method and a developer circulating system will be described. First, the developer is drawn up to the surface of the developing sleeve 11 by a magnetic pole N2 of the magnet roller 12 with the rotation of the developing sleeve 11. When the drawn-up developer is carried from pole S2 to pole N1, a layer thickness is regulated by the regulating blade 15 which is disposed perpendicularly to the developing sleeve 11, so that the thin developer layer is formed on the developing sleeve 11. When the formed thin layer of the developer is carried to a developing main pole S1, it ears up by the magnetic force and is formed into a magnetic brush. The electrostatic image on the photosensitive drum 1 is developed by the developer formed into the ear-shaped magnetic brush. Thereafter, the developer on the developing sleeve 11 is returned into the developing container 16, peeled off by the repulsive magnetic field of poles N3 and N2, and recovered into the developing container 16.

During the developing, a developing bias obtained by superposing direct-current and alternating-current voltages is applied to the developing sleeve 11 from a power source (not shown). In the first embodiment, the direct-current voltage of the developing bias was set to −500 V, the frequency Vf of the alternating-current voltage was 2000 Hz, and peak-to-peak voltage Vpp was 1500 V. Generally in the two-component developing method, when the alternating-current voltage is applied, the developing efficiency increases, and the quality of the image is enhanced, but conversely fog is easily generated. Therefore, the fog is usually prevented by making a potential difference between the direct-current component of the developing bias and the surface potential of the photosensitive drum 1.

On the other hand, in FIG. 1, transfer materials such as sheets and resin sheets, for example, sheets of paper are supplied from a paper supply (not shown). The sheet is conveyed to the first image forming section I by a transfer belt 8 driven by a driving roller 9 and a driven roller 10, and a yellow toner image on the photosensitive drum 101*a* is transferred onto the sheet by the action of the transfer roller 101*c*. The transfer residual toner remaining on the photosensitive drum 101*a* is collected to the developing unit 101*d* for the next developing by the system of cleaning simultaneous with developing.

A similar process is also performed in the second image forming section II, and for example, the toner image of a second color, for example, cyan is transferred onto the yellow toner image on the sheet. By performing similar processes in the third and fourth image forming sections III, IV, a color image with superposed/transferred four-color toner images of yellow, cyan, magenta, and black is obtained on the sheet.

In the first embodiment, a magnetic brush charger for placing a magnetically held particle layer in contact with the image bearing member to perform charging is used in the primary chargers 101*b* to 104*b*. The charger is constituted by allowing a rotatable nonmagnetic sleeve with a fixed magnet disposed therein to bear magnetic particles by the magnetic field, is formed in a brush shape, and carries the magnetic particles by the rotation of the nonmagnetic sleeve (charging sleeve). In the first embodiment, the outer diameter of the nonmagnetic sleeve was set to 16 mm, the rotation direction was counter to the photosensitive drums 101*a* to 104*a*, the rotation speed of the photosensitive drum was 100 mm/second, and the nonmagnetic sleeve was rotated at 150 mm/second.

The charging voltage is applied to this nonmagnetic sleeve, the electric charge is applied to the surface of the photosensitive drum from the magnetic particles, and the surface of the photosensitive drum is charged to provide substantially the same potential as that of the applied voltage. When the rotation speed of the nonmagnetic sleeve is faster, the charging uniformity tends to become better.

As the magnetic particles constituting the charging member, the average particle diameter is preferably in a range of 10 to 100 $\mu$m, saturation magnetization is in a range of 20 to 250 emu/cm$^3$, and resistance is in a range of $1\times10^2$ to $1\times10^{10}$ Ωcm. When it is considered that an insulation defect like a pinhole is present in the photosensitive drum, the resistance is more preferably $1\times10^6$ Ωcm or more. Since a small resistance is preferable for use in order to enhance the charging performance, in the first embodiment, the magnetic particles with an average particle diameter of 25 $\mu$m, saturation magnetization of 200 emu/cm$^3$, and resistance of $5\times10^6$ Ωcm were used. The contact width of the particle layer formed on the photosensitive drum was adjusted so as to substantially provide 6 mm.

Here, after 2 g of magnetic particles were applied into a metal cell with a bottom area of 228 $mm^2$, a load of 6.6 kg was applied, and a voltage of 100 V was applied, the resistance value of the magnetic particles was measured.

As the magnetic particles, a resin carrier formed by dispersing a magnetite as a magnetic material in a resin and dispersing carbon black for electric conduction and resistance adjustment, a ferrite or another magnetite whose surface is oxidized, reduced and treated to adjust the resistance, a ferrite or another magnetite whose surface is coated with the resin to adjust the resistance, and the like can be used.

After the toner image is transferred, the transfer residual toner remains on the surface of each of the photosensitive drums 101*a* to 104*a*. If this transfer residual toner is passed through the chargers 101*b* to 104*b* as it is, ghost is generated. Even when the transfer residual toner passes below the charging brush in contact with the photosensitive drum, the shape of the previous image is maintained in most cases. When the magnetic brush is set in adequate charging conditions, the toner fails to be uniformly dispersed.

Therefore, the transfer residual toner which has reached the charging area with the rotation of the photosensitive drums 101*a* to 104*a* is taken by the magnetic brushes of the chargers 101*b* to 104*b*, and the trace of the previous image needs to be erased. In this case, when the direct-current voltage is only applied to the magnetic brush, the toner is insufficiently taken by the magnetic brush. However, by applying the alternating-current voltage to the magnetic brush, the toner is relatively easily taken to the magnetic brush by the vibration effect of the electric field between the image bearing member and the charger.

However, in some cases it is very difficult to take the toner onto the magnetic brush depending on the charging amount of the transfer residual toner which has reached the charging area. Specifically, as long as the transfer residual toner is electrically charged, a potential difference between the magnetic brush and the photosensitive drum or a reflection force (mirroring force) between the toner and the photosensitive drum has a large influence on the taking property.

Here, the surface of the passing photosensitive drum is ideally equally charged with respect to the voltage applied to the magnetic brush. The contact portion of the magnetic brush actually has a width. Even when the surface is finally charged to provide the substantially equal potential, a sufficient charging is not realized in the initial stage in which the photosensitive drum passes through the contact portion. Therefore, the potential difference is generated between the charger and the photosensitive drum.

In the first embodiment, the applied direct-current voltage Vdc of each of the magnetic brush chargers 101*b* to 104*b* is set to −700V. Therefore, the positive charge toner is easily taken toward the magnetic brush, but no negative charge toner is taken in an area where the surface potentials of the photosensitive drums 101*a* to 104*a* are lower in the initial stage of the passage through the contact portion. Moreover, when the charging amount of the transfer residual toner is extremely large, and the reflection force with the photosensitive drum is too large, the toner remains on the photosensitive drum. Therefore, although the toner is originally charged to be negative, the transfer residual toner is preferably charged to be positive. However, even when the toner is not positively charged, with the sufficiently small absolute value of charging amount, the effect of forcibly scraping off the toner by the magnetic brush can be expected.

Actually in many cases, the charging polarity of the transfer residual toner is reversed by a peeling discharge, and the like during the transfer. Even at the equal transfer efficiency, however, the charging amount distribution of the transfer residual toner largely differs in accordance with a transfer current. Moreover, after long use, the developer itself is deteriorated, the transfer efficiency is lowered, and the ratio of the negative charge toner remaining on the photosensitive drum therefore increases. To solve the problem, it is preferable to dispose means which strengthens the transfer current and charges the transfer residual toner to provide an opposite polarity.

In the first embodiment, a brush (not shown) of conductive fiber of rayon with a length of 6 mm is disposed as second charging means between each transfer charger (101*c* to 104*c*) and the magnetic brush charger (101*b* to 104*b*), and each brush is allowed to abut on each of the photosensitive drums 101*a* to 104*a* with a contact width of 7 mm. Subsequently, a direct-current voltage of 500 V with a plus polarity reverse to the charging polarity is applied to this brush. Since this plus voltage is applied, the transfer residual toner with the negative polarity is temporarily caught in the brush. After charge is removed, the toner is again fed onto the photosensitive drum. Therefore, only the plus toner or only the minus toner with electricity removed therefrom and with a low charging amount enters the contact portion between each magnetic brush of the chargers 101*b* to 104*b* and each of the photosensitive drums 101*a* to 104*a*, and is easily recovered with the charger.

The collected toner is again charged with a minus charge by friction with the magnetic particles of the magnetic brush, and uniformly discharged onto the photosensitive drum. The toner discharged onto the photosensitive drum reaches the developing area, and remains on the photosensitive drum as it is when present in the exposing section of the next image. When the toner is present in a non-exposing section, it is recovered to the developing unit and used again as the developer.

In the present invention, a usually used organic photosensitive member, and the like can be used as the photosensitive drums 101*a* to 104*a*. Preferably, when the photosensitive member having a surface layer with a resistance value of $10^9$ to $10^{14}$ Ωcm, an amorphous silicon photosensitive member, and the like are used, electric charge injection charging can be realized, ozone is prevented from being generated, and consumption power is effectively reduced. Moreover, the charging property can also be enhanced.

In the first embodiment, a negative charge organic photosensitive member, that is, a photosensitive drum with the following first to fifth layers disposed in order from below on an aluminum drum base member with a diameter of 30 mm was used.

The first layer is an undercoating layer disposed in order to rectify the defect or the like of the aluminum base member, and is constituted of a conductive layer with a thickness of 20 μm.

The second layer is a positive charge injecting preventive layer, plays a role of preventing the positive charge injected from the base member from counteracting the negative charge applied on the photosensitive member surface, and is constituted of a medium resistance layer with a thickness of 1 μm whose resistance is adjusted to be about $10\times10^6$ Ωcm by alamine resin and methoxymethyl nylon.

The third layer is a charge producing layer with a thickness of about 0.3 μm in which a diazo pigment is dispersed in a resin, and produces a pair of positive and negative charges by exposure to light.

The fourth layer is a charge transporting layer constituted by dispersing hydrazone in a polycarbonate resin, and a P-type semiconductor. Therefore, the negative charge applied to the photosensitive member surface cannot move in this layer, and only the positive charge produced in the charge producing layer can be transported to the photosensitive member surface.

The fifth layer is a charge injecting layer which is coated with a material of $SnO_2$ ultrafine particles dispersed in an insulating resin binder. Specifically, the layer is coated with a material obtained by doping antimony as a light transmitting insulation filler to the insulating resin in order to lower resistance (conduct electricity), and dispersing 70% by weight of $SnO_2$ particles with a particle diameter of 0.03 $\mu$m to the resin.

The material is prepared as described above and formed into an about 3 $\mu$m thick coat by appropriate coating methods such as a dipping method, a spray coating method, a roll coating method, and a beam coating method, so that the charge injecting layer can be formed.

In the first embodiment the image forming apparatus has a black monochromatic mode. During the monochromatic mode, no image is formed in the first, second, and third image forming sections I, II, III, and the photosensitive drums 101*a,* 102*a,* 103*a* rotate, but the developing units 101*d,* 102*d,* 103*d* stop rotation driving and high-pressure output. The second and third image forming sections II, III are cyan and magenta image forming sections, and the transfer bias to the transfer chargers 102*c,* 103*c* is in an OFF state. However, since the sheet supplied from the sheet supply section is adsorbed to the transfer belt 8 in the yellow, first image forming section I, a current of 3 $\mu$A is applied to the transfer charger 101*c*.

In the conventional method, when this black monochromatic mode is frequently used, no toner is consumed and paper dust dirties the photosensitive drum surface in the yellow, cyan, and magenta photosensitive drums 101*a,* 102*a,* 103*a*. Moreover, particularly in the yellow mode, since the transfer bias is applied, the smeared image is more remarkably generated. Furthermore, when the corona charging system is used as the charging apparatus, HNO adhesion amount becomes the largest. Therefore, the smeared image is in a further worsened state.

To solve the problem, in the first embodiment, the contact system charging apparatus, particularly the magnetic brush charger which can collect the residual toner on the particle layer is used. Even in the black monochromatic mode, the magnetic brush chargers 101*b,* 102*b,* 103*b* of other color image forming sections are rotated/driven. Thereby, the paper dust or HNO adhering to the surfaces of the photosensitive drums 101*a* to 103*a* are removed by the magnetic brush charger. Even when the image formation is performed in the color mode, no smeared image is generated. Originally, the electric discharge phenomenon hardly occurs in the charger, but this also advantageously acts, because the magnetic brush charges is used.

Hereinafter, further improvements will be explained.

As described above, the charge injecting layer of the photosensitive drum is about 3 $\mu$m in the magnetic brush charging. When the photosensitive drum surface is excessively abraded by the rotation of the charger, the life of the photosensitive drum is shortened. When this charge injecting layer is lost, in the photosensitive member used in the first embodiment, the injection charging itself is not established, a charging defect is caused, and a fog image results. Particularly in the black monochromatic mode, when the charge injecting layer is abraded by rotating the charger of the color with which no image is formed, in an extreme case, the image forming unit of this color expires before images are produced. Specifically, the number of revolutions is suppressed to the necessary minimum number to such an extent that the smeared image is prevented, which is advantageous for lengthening the life.

According to the inventors' researches, it has been found that the shaving of the charge injecting layer is largely influenced by the presence of the externally applied agent of the toner. Specifically, when the magnetic particles are completely new and are not contaminated at all, the charge injecting layer is not worn even by the rotation in contact with the photosensitive drum. However, when the image formation is performed and the transfer residual toner is mixed in the magnetic particles, the charge injecting layer is worn. When the mixing amount increases, the wearing is accelerated. Therefore, the rotation amounts of the other color chargers during the black monochromatic mode are preferably variable in accordance with the image forming amount.

In the first embodiment, there are provided counting means for counting the number of sheets with the past color images printed thereon, comparing means for comparing the counted value with a predetermined threshold value of the number of printed sheets, and sleeve rotation controlling means for controlling the number of revolutions of the sleeve of the magnetic brush charger. During the black monochromatic mode, the number of revolutions of each sleeve of the chargers 101*b* to 103*b* is controlled based on a comparison result by the comparing means. When the number of printed sheets increases, the number of revolutions is reduced.

Specifically, the chargers 101*b* to 103*b* continue rotating even during the black monochromatic mode until the number of the past printed sheets reaches 10,000 sheets. In a range of 10,000 to 30,000 sheets, the charger rotates only while the sheet passes through the transfer area on the transfer belt. The unit stops in a sheet interval or during post-rotation. Moreover, when the number reaches or exceeds 30,000 sheets, the charger is inhibited from rotating in consideration of excess wear on the photosensitive member.

For the yellow, cyan, or magenta photosensitive drum 101*a,* 102*a,* 103*a* whose durable life is 50,000 sheets in the color original with an image ratio of 6%, when 1,000 sheets each of color image and black monochromatic image are alternately printed, the life is originally 50,000 sheets only of the color image. However, when the chargers 101*b,* 102*b,* 103*b* continued rotating even for black monochromatic printing, at 40,000 sheets the charge injecting layer was completely worn, and the fog started to be generated by charging failure. Moreover, during the black monochromatic mode, when the chargers 101*b* to 103*b* entirely stopped rotating, the smeared image was generated in the color image after the first 1,000 sheets of black monochromatic images under an environment with a temperature of 30° C. and a humidity of 80%.

To solve the problem, in the first embodiment, the number of revolutions of the chargers 101*b* to 103*b* is controlled as described above during the black monochromatic mode. In this case, almost no wear is found on the photosensitive drums 101*a* to 103*a* during the black monochromatic mode, and the life of 50,000 sheets only of the color images can be maintained.

Second Embodiment

In a second embodiment, the integrated value of the printing amount was used as the past operation history information of the image forming sections I, II, III of the colors other than black.

Although not described in the first embodiment, in the process cartridge in which the photosensitive member, the charger , and the developing apparatus are integrally constituted, each cartridge stores the information on the operation amount, and the information needs to be read and subjected to various controls on the side of the image forming apparatus main body.

Figure 3:
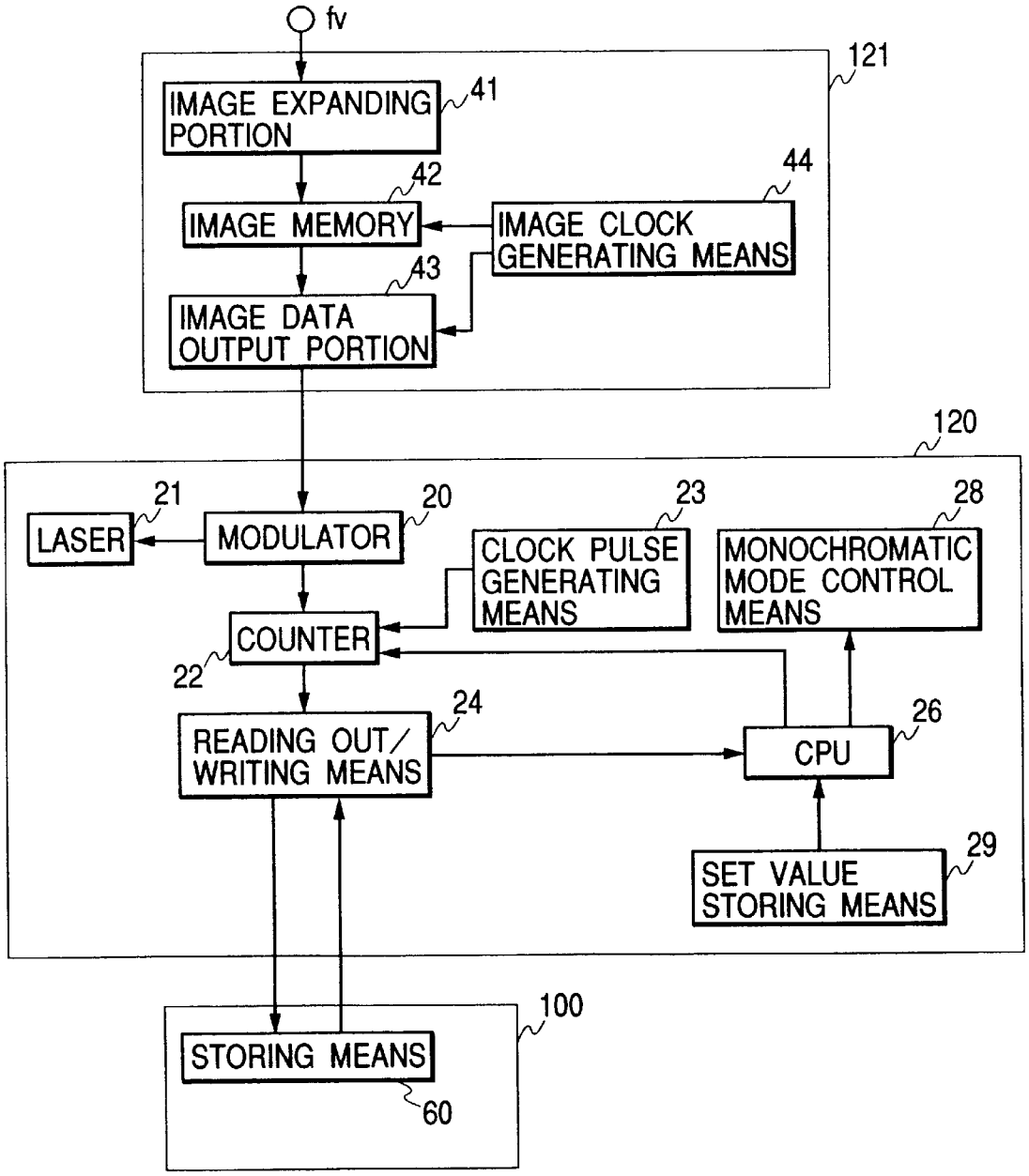
FIG. 3 is a block diagram showing the operation of the image forming apparatus in another embodiment of the present invention.

As shown in FIG. 3, the second embodiment is characterized in that a process cartridge 100 is provided with storing means 60. When the integrated value of the image printing amount stored in this storing means 60 exceeds a predetermined value, the number of revolutions of each charging sleeve of the magnetic brush chargers 101*b*, 102*b*, 103*b* in the color image forming sections I, II, III during the black monochromatic mode is accordingly changed, and the wear of each charge injecting layer of the photosensitive drums 101*a*, 102*a*, 103*a* is suppressed, so that the smeared image is prevented.

The storing means 60 is not particularly limited as long as it stores and holds signal information so that the information can be rewritten and, for example, electric storing means such as a RAM and a rewritable ROM, magnetic storing means such as a magnetic recording medium, a magnetic bubble memory, and an optomagnetic memory, and the like are used. In the second embodiment, a nonvolatile (NV) RAM as nonvolatile storing means was used because of handiness and cost respect.

FIG. 3 is a block diagram showing a mechanism for controlling the number of revolutions of the charging sleeve during the black monochromatic mode in the second embodiment, and shows the cartridge 100, an image forming apparatus main body 120 and a controller 121 for converting printing data to a printable signal.

In the second embodiment, the lighting time of a laser is counted as the information indicating the printing amount after the start of image formation, and the counted value is stored as time information in the storing means 60 in the cartridge 100.

In FIG. 3, printing data fv inputted from a host computer (not shown) or the like is inputted to the controller 121, and expanded to provide dot data in an image expanding portion 41. After the expanded printing data is once stored in an image memory 42, the data is transmitted as a serial image signal to the electrophotographic image forming apparatus main body 120 from an image data output portion 43. In FIG. 3, reference numeral 44 denotes image clock generating means.

The image signal transmitted to the apparatus main body 120 is modulated to a laser input voltage for turning on/off a laser 21 in response to the image signal fv by a modulator 20. Specifically, the laser 21 is connected to the modulator 20, and emits light in response to the modulated signal. Moreover, the modulator 20 is connected to a counter 22, and the time information indicating the output time to the laser 21 from the modulator 20, that is, the exposure time of the photosensitive drum 1 to a laser beam outputted from the laser 21 is measured by this counter 22. Specifically, the counter 22 is connected to clock pulse generating means 23 like a crystal oscillator, and counted value of the number of clock pulses received while a laser emitting signal continues to exist is used as the time information. Here, the measured number of clock pulses is added and successively written to the storing means 60 disposed in the cartridge by reading out/writing means 24.

In the second embodiment, since the laser exposure time is directly counted by the number of clocks, for example, a multi-level signal for lengthening the emitting time for one dot of laser pixel with respect to an image high-density portion and shortening the emitting time for one dot of pixel with respect to an image medium-density portion can also be utilized as the image signal.

The time information written to the storing means 60 is again written to the electrophotographic image forming apparatus main body 120 by the reading out/writing means 24. The value is compared with a predetermined value in a CPU 26 by the CPU 26. When the value is larger than the predetermined value, the number of revolutions of the charging sleeve during the black monochromatic mode is switched by monochromatic mode control means 28.

A plurality of predetermined values can be set. For example, for two set values a, b, when time information T read from the storing means 60 has relations (i) $T<a$, (ii) $a \leqq T<b$, and (iii) $b \leqq T$, control is performed in three stages: (i) rotation is constantly performed; (ii) the rotation is performed only while the sheet passes through the transfer area; and (iii) the rotation is not performed at all. Additionally, a, b indicate the time information when 10,000 sheets and 30,000 sheets are printed, respectively, from the original with an image ratio of 6%.

Figure 4:
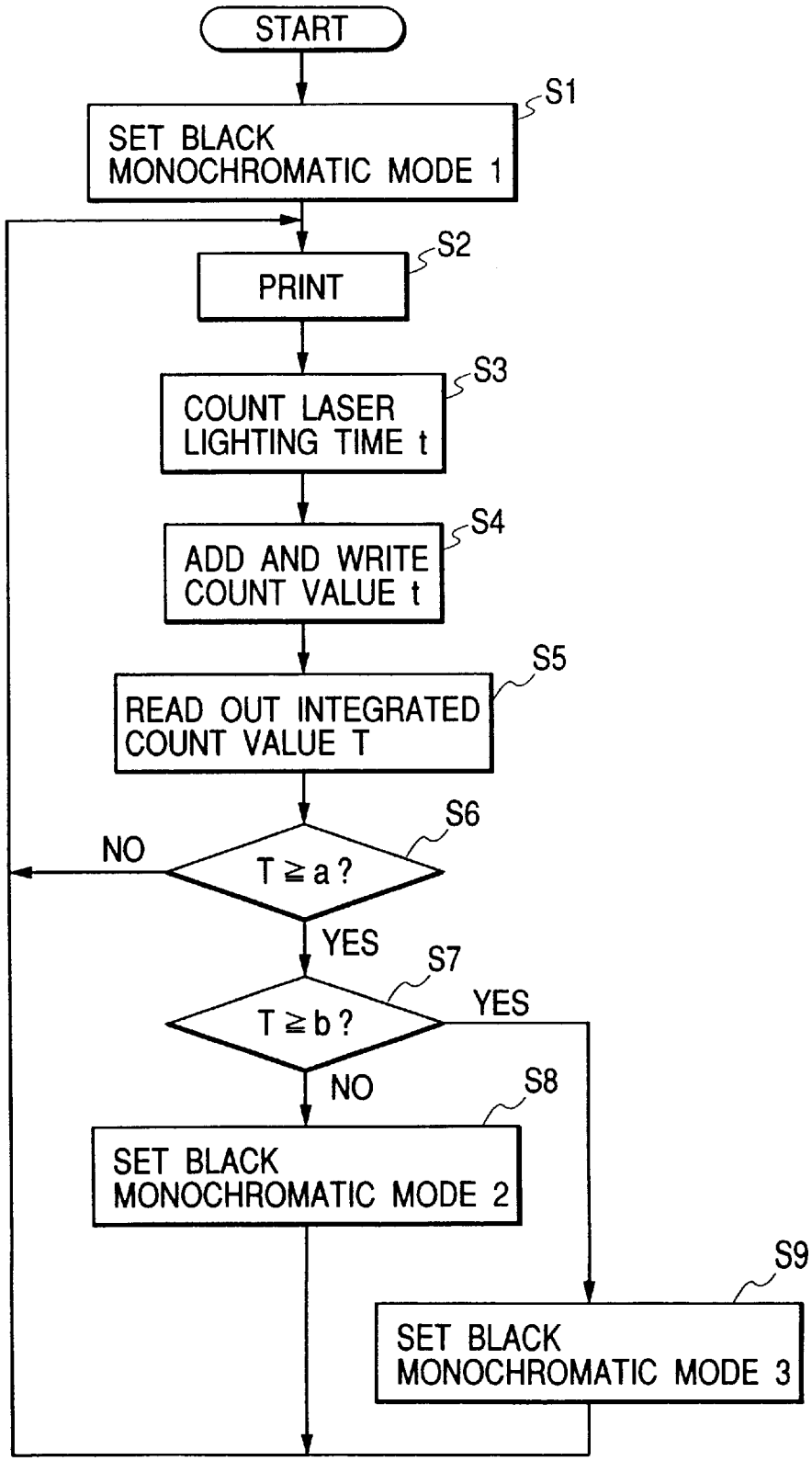
FIG. 4 is a flowchart showing the operation of FIG. 3.

The flow of operation of the second embodiment will next be described with reference to a flowchart of FIG. 4. First, printing starts, a black monochromatic mode 1 is set (step S1), and the printing is executed (S2). Then, the counted value t of clock pulses indicating the laser lighting time by the printing is measured (S3), and the adding/writing is performed on the storing means 60 by the reading out/writing means 24 (S4). The integrated value T of the counted value t of the clock pulses written into the storing means 60 is again read into the apparatus main body 120 (S5), the size is successively compared with the set values a, b (S6, S7), and the charging sleeve rotating time during the black monochromatic mode is determined and set (S8, S9).

In the second embodiment, according to the above-described constitution, the number of revolutions of the charging sleeve during the black monochromatic mode is controlled in accordance with the deteriorated situation of the magnetic particles of the magnetic brush chargers 101*b* to 103*b* regardless of the image ratio of the printing original. The photosensitive drums 101*a*, 102*a*, 103*a* are prevented from being abraded wastefully, the smeared image can be prevented, and the durable life equal to that during the printing of only the color images can be maintained.

As described above, according to the present invention, in the tandem type color electrophotographic image forming apparatus, in order to solve the problem that the smeared image is easily generated in the photosensitive members (image bearing members) of the image forming sections of the colors other than black during the monochromatic mode, the contact charger is used as the photosensitive member charging means. The charger of the image forming section with which no image is formed is rotated even during the monochromatic mode. Therefore, the materials adhering onto the photosensitive member can be removed, and the smeared image can be prevented. By using the magnetic brush charger of the injection charging system as the contact charger, the electric discharge phenomenon during the charging can be eliminated more effectively. Moreover, since the cleanerless system is used and the magnetic brush with a relatively small abrading force to the photosensitive member is used, the photosensitive member of the image forming section of the color with which no image is formed is prevented from being excessively deteriorated during the monochromatic mode. Moreover, by controlling the number of revolutions during the monochromatic mode in accordance with the deterioration degree of the charger, the smeared image is minimized and prevented, and the life can be maintained without excessively abrading the photosensitive member. In the process cartridge, since the cartridge is provided with the storing means, the number of revolutions of the charging apparatus during the monochromatic mode can be controlled in accordance with the operation situation of each cartridge.

The present invention is not necessarily limited to the magnetic brush charger. Nonmagnetic particles having a abrasive ability on the image bearing member can be used. Moreover, other various alternatives such as the method of controlling the number of revolutions of the charging sleeve and the means of integrating operation history can be used. Furthermore, in the tandem system, the present invention can be applied not only to the image forming apparatus in which the toner image on each color image bearing member (photosensitive member) is directly transferred to the transfer material sheet or the resin sheet, but also to the image forming apparatus in which the second image bearing member (medium transfer member) is used as the transfer material, each color toner image is once transferred onto the second image bearing member, and subsequently the toner images are collectively transferred to the sheet or the like, further to the two-color image forming apparatus instead of the full-color apparatus.

The embodiments of the present invention have been described above, but the present invention is not limited to these embodiments and can variously be modified within the technical scope.

What is claimed is:

1. An image forming apparatus comprising:

first image forming means provided with a rotating first image bearing member for bearing a first color toner image;

second image forming means provided with a rotating second image bearing member for bearing a second color toner image different in color from the first color toner;

transferring means being able to overlap the toner images of said first image bearing member and said second image bearing member onto a member to be transferred, or transferring one of the toner images to the transfer member to be transferred;

each of said first and second image forming means includes a rotating charging member, which is in contact with surfaces of said first and second image bearing members from which no after-transfer residual toner is removed, and a developing unit for developing an electrostatic image on said image bearing member; and rotation controlling means for controlling rotation of said charging member and said first and second image bearing members;

said apparatus having a monochromatic mode for image formation in monochromatic color, and said rotation controlling means rotating said second image bearing member and said charging member of said second image foiming means in the monochromatic mode.

2. An image forming apparatus according to claim 1, wherein said charging member has a particle layer in contact with said image bearing member, and the particle layer temporarily collects the residual toner.

3. An image forming apparatus according to claim 2, wherein the particle layer returns the collected toner to said first and second image bearing members, and said developing unit collects the toner on said image bearing member.

4. An image forming apparatus according to claim 2, wherein said particle layer has a magnetic property, and said charging member has a magnet which bears the particle layer by a magnetic force.

5. An image forming apparatus according to claim 2, wherein a volume resistance value of particles in said particle layer is in a range of $10^2$ to $10^{10}$ Ωcm.

6. An image forming apparatus according to claim 2, wherein said first and second image forming means further include a reverse charging member, disposed on an upstream side of a rotation direction of said first and second image bearing members from said charging member, and on a downstream side from said transferring means, for charging the residual toner to provide a polarity reverse to a charging polarity caused by said charging member.

7. An image foiming apparatus according to claim 1, wherein a voltage is applied to said charging member of said second image forming means during the image formation only with said first image forming means.

8. An image forming apparatus according to claim 1, further comprising integrating means for integrating the number of formed images of each image forming means.

9. An image forming apparatus according to claim 8, wherein said rotation controlling means variably controls the rotation of said charging member of said image forming means performing no image formation in accordance with an integrated number of said integrating means.

10. An image forming apparatus according to claim 8, further comprising voltage controlling means for controlling a voltage applied to said charging member, said voltage controlling means variably controlling the voltage applied to said charging member of said image forming means performing no image formation in accordance with an integrated number of said integrating means.

11. An image forming apparatus according to claim 8, wherein each of said first and second image forming means includes a process cartridge provided with at least an image bearing member and detachably attached to an apparatus main body, and said process cartridge has said integrating means.

12. An image forming apparatus according to claim 11, wherein said integrating means has a writable and readable memory.

* * * * *

UNITED STATES PATENT AND TRADEMARK OFFICE

CERTIFICATE OF CORRECTION

PATENT NO. : 6,314,251 B1
DATED : November 6, 2001
INVENTOR(S) : Fumiteru Gomi et al.

It is certified that error appears in the above-identified patent and that said Letters Patent is hereby corrected as shown below:

Title page,
Item [57], ABSTRACT,
Line 2, "device" should read -- devices --.

Column 4,
Line 25, "to" should read -- in --.

Column 7,
Line 56, "is" should read -- are --.

Column 8,
Line 38, "transfer." should read -- transfer --.

Column 9,
Line 4, "charger ," should read -- charger, --.

Column 11,
Line 11, "a" should read -- an --.

Column 12,
Line 3, "foiming" should read -- forming --; and
Line 28, "foiming" should read -- forming --.

Signed and Sealed this

Ninth Day of April, 2002

*Attest:*

*Attesting Officer*

JAMES E. ROGAN
*Director of the United States Patent and Trademark Office*